United States Patent [19]

Hamner, deceased et al.

[11] Patent Number: 4,943,672

[45] Date of Patent: Jul. 24, 1990

[54] PROCESS FOR THE HYDROISOMERIZATION OF FISCHER-TROPSCH WAX TO PRODUCE LUBRICATING OIL (OP-3403)

[75] Inventors: Glen P. Hamner, deceased, late of Baton Rouge, La., by Annabelle Hamner, executrix; Heather A. Boucher, Point Edward, Canada; William A. Wachter, Baton Rouge, La.

[73] Assignee: Exxon Research and Engineering Company, Florham Park, N.J.

[21] Appl. No.: 283,643

[22] Filed: Dec. 13, 1988

Related U.S. Application Data

[63] Continuation-in-part of Ser. No. 134,797, Dec. 18, 1987, abandoned.

[51] Int. Cl.[5] ..... C07C 5/13

[52] U.S. Cl. ..... 585/737; 585/253; 585/733; 585/748; 585/749; 208/18; 208/27; 208/58; 208/112

[58] Field of Search ..... 208/18, 24, 27, 58, 208/112; 585/748, 749, 734, 738

[56] References Cited

U.S. PATENT DOCUMENTS

| | | | |
|---|---|---|---|
| 2,668,790 | 2/1954 | Good et al. | 208/95 |
| 2,668,866 | 2/1954 | Good et al. | 208/46 |
| 2,817,693 | 12/1957 | Koome et al. | 208/46 |
| 3,052,622 | 9/1962 | Johnson et al. | 208/27 |
| 3,338,843 | 8/1967 | Goble et al. | 502/230 |
| 3,365,390 | 1/1968 | Egan et al. | 208/112 |
| 3,486,993 | 12/1969 | Egan et al. | 208/89 |
| 3,487,005 | 12/1969 | Egan et al. | 208/59 |
| 3,658,689 | 4/1972 | Steinmetz et al. | 208/46 |
| 3,709,817 | 1/1973 | Suggit et al. | 208/112 |
| 3,717,586 | 2/1973 | Suggit et al. | 208/108 |
| 3,830,723 | 8/1974 | Ladeur et al. | 208/108 |
| 3,915,843 | 10/1975 | Franck et al. | 208/112 |
| 4,139,494 | 2/1979 | Itoh et al. | 208/27 |
| 4,428,819 | 1/1984 | Shu et al. | 208/46 |
| 4,579,986 | 4/1986 | Sie | 208/950 |
| 4,594,172 | 6/1986 | Sie | 208/18 |
| 4,608,151 | 8/1986 | Miller et al. | 208/27 |
| 4,684,756 | 8/1987 | Derr, Jr. et al. | 585/330 |
| 4,832,819 | 5/1989 | Hamner | 208/58 |

*Primary Examiner*—Anthony McFarlane
*Attorney, Agent, or Firm*—Roy J. Ott

[57] ABSTRACT

Fischer-Tropsch wax is converted to a lubricating oil having a high viscosity index and a low pour point by first hydrotreating the wax under relatively severe conditions and thereafter hydroisomerizing the hydrotreated wax in the presence of hydrogen on a particular fluorided Group VIII metal-on-alumina catalyst. The hydroisomerate is then dewaxed to produce a premium lubricating oil base stock.

14 Claims, 1 Drawing Sheet

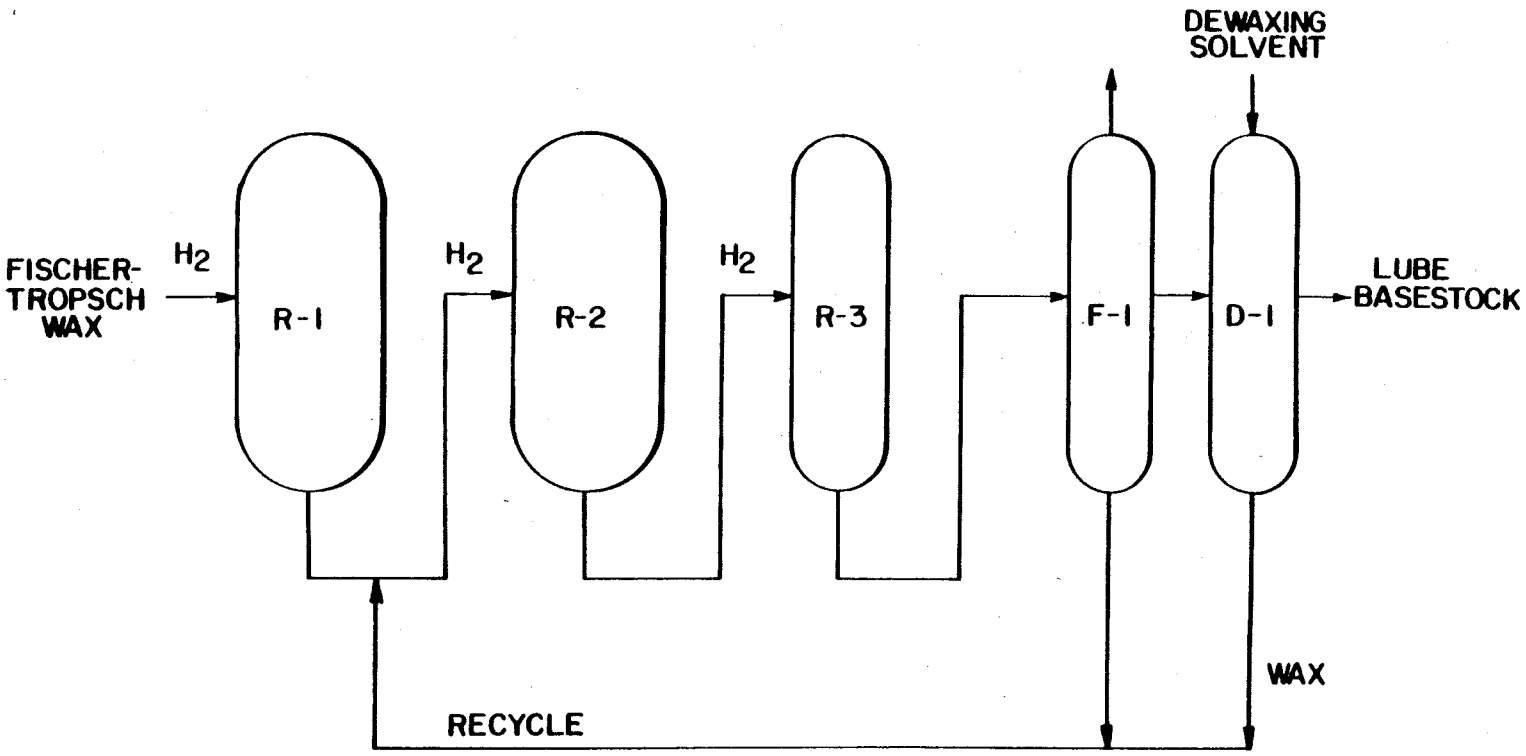
FIGURE

PROCESS FOR THE HYDROISOMERIZATION OF FISCHER-TROPSCH WAX TO PRODUCE LUBRICATING OIL (OP-3403)

CROSS-REFERENCE TO COPENDING APPLICATION

This is a Continuation-in-Part application of copending application Serial No. 134,797 filed Dec. 18, 1987, now abandoned.

BACKGROUND OF THE INVENTION

I. Field of the Invention

This invention relates to a process for producing lubricating oil from a Fischer-Tropsch wax. More particularly, it relates to a process utilizing a Group VIII metal-on-alumina catalyst for hydroisomerizing a hydrotreated Fischer-Tropsch wax to produce a lubricating oil having a high viscosity index and a low pour point.

II. Description of the Prior Art

In the Fischer-Tropsch process a synthesis gas ($CO+H_2$) made, e.g., from natural gas, is converted over a catalyst, e.g., a ruthenium, iron or cobalt catalyst, to form a wide range of products inclusive of gaseous and liquid hydrocarbons, and oxygenates, and a normally solid paraffin wax which does not contain the sulfur, nitrogen or metals impurities normally found in crude oil. It is generally known to catalytically convert the paraffin wax, or syncrude obtained from such process to lower boiling paraffinic hydrocarbons falling within the gasoline and middle distillate boiling ranges.

Paraffin waxes have been isomerized over various catalysts, e.g., Group VIB and VIII catalysts of the Periodic Table of the Elements (E. H. Sargent & Co., Copyright 1964 Dyna-Slide Co.) Certain of such catalysts can be characterized as halogenated supported metal catalysts, e.g., a hydrogen chloride or hydrogen fluoride treated platinum-on-alumina catalyst as disclosed, e.g., in U.S. Pat No. 2668,866 to G. M. Good et al. In the Good et al. process a partially vaporized wax, such as one from a Fischer-Tropsch synthesis process, is mixed with hydrogen and contacted at 300° C. to 500° C. over a bed of supported platinum catalyst. Palladium or nickel may be substituted for platinum. The support may be a number of conventional carrier materials, such as alumina or bauxite. The carrier material may be treated with acid, such as HCl or HF, prior to incorporating the platinum. In preparing the catalyst, pellets of activated alumina may be soaked in a solution of chloroplatinic acid, dried and reduced in hydrogen at 475° C.

U.S. Pat. No. 2,817,693 discloses the catalyst and process of U.S. Pat. No. 2,668,866 with the recommendation that the catalyst be pretreated with hydrogen at a pressure substantially above that to be used in the process.

U.S. Pat. No. 3,268,439 relates to the conversion of waxy hydrocarbons to give products which are characterized by a higher isoparaffin content than the feedstock. Waxy hydrocarbons are converted at elevated temperature and in the presence of hydrogen by contacting the hydrocarbons with a catalyst comprising a platinum group metal, a halogenatable inorganic oxide support and at least one weight percent of fluorine, the catalyst having been prepared by contacting the support with a fluorine compound of the general formula:

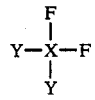

where X is carbon or sulphur and Y is fluorine or hydrogen.

U.S. Pat. No. 3,308,052 describes a hydroisomerization process for producing lube oil and jet fuel from waxy petroleum fractions. According to this patent, product quality is dependent upon the type of charge stock, the amount of liquid hydrocarbon in the waxy charge stock and the degree of conversion to products boiling below 650° F. The greater the amount of charge stock converted to material boiling below 650° F. per pass the higher the quality of jet fuel. The catalyst employed in the hydroisomerization zone is a platinum group metal catalyst comprising one or more platinum, palladium and nickel on a support, such as alumina, bentonite, barite, faujasite, etc., containing chlorine and/or fluorine.

In U.S. Pat. No. 3,365,390 a heavy oil feed boiling at least partly above 900° F. is hydrocracked and the oil effluent thereof is separated into fractions, including a distillate fuel and a higher boiling hydrocracked lube oil boiling range fraction. The hydrocracked lubricating oil boiling range fraction is dewaxed to obtain a hydrocracked wax fraction which is hydroisomerized in the presence of a reforming catalyst and the oil effluent thereof is separated into fractions, including a distillate fuel and an isomerized lube oil boiling range fraction.

In U.S. Pat. No. 3,486,993 the pour point of a heavy oil is lowered by first substantially eliminating organic nitrogen compounds present in the oil and then contacting the nitrogen-free oil with a reforming catalyst in a hydrocracking-hydroisomerization zone. Hydroisomerization is conducted at a temperature of 750°πF.—900° F. over a naphtha reforming catalyst containing no more than two weight percent halide.

U.S. Pat. No. 3,487,005 discloses a process for the production of low pour point lubricating oils by hydrocracking a high pour point waxy oil feed boiling at least partly above 700° F. in at least two stages. The first stage comprises a hydrocrackingdenitrofication stage, followed by a hydrocrackingisomerization stage employing a naphtha reforming catalyst containing a Group VI metal oxide or Group VIII metal on a porous refractory oxide, such as alumina. The hydrocracking isomerization catalyst may be promoted with as much as two weight percent fluorine.

U.S. Pat. No. 709,817 describes a process which comprises contacting a paraffin hydrocarbon containing at least six carbon atoms with hydrogen, a fluorided Group VIB or VIII metal alumina catalyst and water. These catalysts are classified by the patentee as a well-known class of hydrocracking catalysts.

III. Summary of the Invention

A process for producing a lubricating oil having a high viscosity index and a low pour point from a Fischer-Tropsch wax which process comprises:

(a) contacting the Fischer-Tropsch wax with a hydrotreating catalyst and hydrogen to reduce the oxygenate and trace metal levels of the wax and to partially hydrocrack/isomerize the wax;

(b) contacting the hydrotreated Fischer-Tropsch wax from step (a) with hydrogen in a hydroisomerization zone in the presence of a fluorided Group VIII metal-on-alumina catalyst having (i) a bulk fluoride concentration ranging from about 2 to 10 weight percent, wherein the fluoride concentration is less than about 3.0 weight percent at the outer surface layer to a depth less than one one hundredth of an inch provided the surface fluoride concentration is less than the bulk fluoride concentration, (ii) an aluminum fluoride hydrate level greater than 60 where an aluminum fluoride hydrate level of 100 corresponds to the X-ray diffraction peak height of 5.66Å for a Reference Standard;

(c) fractionating the effluent from step (b) to produce a lubricating oil fraction boiling at atmospheric pressure above about 640° F., preferably above 700° F.; and (d) dewaxing the lubricating oil fraction from step (c) to produce a dewaxed lubricating oil having a viscosity index of at least 130 and a pour point less than about 0° F.

In preferred embodiments, the hydrotreating catalyst will be unsulfided, the catalyst employed in the hydroisomerization zone will be a fluorided platinum-on-aluminum catalyst, and the isomerate is contacted with hydrogen in the presence of a hydrogenation catalyst to reduce unsaturation of the isomerate and thereby improve its daylight and oxidation stability.

IV. Brief Description of the Drawing

The FIGURE schematically depicts a process of the invention for the production of a lubricating oil boiling substantially in the range of about 700° F. to 1050° F. from a Fischer-Tropsch wax.

V. Description of the Preferred Embodiments

In accordance with the invention, a Fischer-Tropsch wax is hydrotreated under relatively high severity conditions to remove impurities and partially convert the 1050.F+wax, followed by hydroisomerization of the hydrotreated wax, hydrofining of the isomerate to improve daylight stability, fractionation to recover a lubricating oil fraction, and dewaxing to produce a high viscosity, low pour point lubricating oil.

Fischer-Tropsch wax may be made as a by-product from the conversion of natural gas or gasification of coal under known conditions to a synthesis gas ($CO+H_2$) which may then be converted by the Fischer-Tropsch process to form gaseous and liquid hydrocarbons and a normally solid paraffin wax known as Fischer-Tropsch wax. This wax does not contain the sulfur, nitrogen or metal impurities normally found in crude oil, but is known to contain water, trace metals and a number of oxygenate compounds such as alcohols, ketones, aldehydes, etc. These oxygenate compounds have an adverse effect on the performance of the hydroisomerization/hydrocracking catalyst of the invention and it is, therefore, advantageous to produce lube oil products by the process scheme outlined in the FIGURE.

Referring to the FIGURE, a Fischer-Tropsch wax is introduced into Hydrotreater R-1 along with hydrogen and contacted therein with a hydrotreating catalyst. Fischer-Tropsch wax is generally composed of about 99+% normal paraffins, with trace amounts of metals and oxygenates as impurities. It is all high melting wax, and requires considerable structural modification (normal paraffin wax is first converted to iso-paraffin wax before oil is produced). Hydrotreating serves a dual purpose, namely, removal of the impurities and conversion of some of the Fischer-Tropsch wax, particularly the fraction boiling above 1050° F. Hydrotreating at mild conditions removes impurities in the Fischer-Tropsch wax, but more severe hydrotreating conditions are preferred in the process of the present invention in order to convert some of the higher boiling Fischer-Tropsch wax. This is in contrast, for example, to a petroleum slack wax which normally contains some relatively low melting wax which needs only a slight reduction in pour point to become oil. In the case of petroleum slack waxes relatively mild hydrotreating conditions are employed to remove nitrogen and sulfur, while avoiding conversion of the naphthenes and isoparaffins present in the slack wax.

It has been found advantageous, therefore, to employ relatively severe hydrotreating conditions in Hydrotreater R-1 in order to remove impurities and soften the Fischer-Tropsch wax prior to hydroisomerization. These conditions include a temperature in the range of about 650° F. to 775° F., preferably 700° F. to 750° F., a hydrogen pressure between about 500 and 2500 psig (pounds per square inch gauge), preferably between 1000 and 1500 psig, a space velocity of between about 0.1 and 2.0 V/V/Hr (volume of feed/volume of catalyst per hour), preferably 0.2 and 0.5 V/V/Hr, and a hydrogen gas rate between about 500 and 5000 SCF/B (standard cubic feet of hydrogen per barrel of feed), preferably between 1000 and 2000 SCF/B. The hydrotreating catalyst includes the well known hydrotreating catalysts such as Co/Mo or Ni/Mo on alumina. Other hydrotreating catalysts include combination of Co and/or Ni and Mo and/or W on a silica/alumina base. Typically such hydrotreating catalysts are presulfided, but it is preferred to employ a non-sulfided hydrotreating catalyst in R-1.

The hydrotreated Fischer-Tropsch wax from R-1 is introduced into Hydroisomerization Reactor R-2 along with fresh hydrogen or dewatered recycle hydrogen and contacted therein under hydroisomerization conditions with a fluorided Group VIII metal-on alumina catalyst.

Hydroisomerization is carried out at temperatures ranging between about 500° F. and 750° F., preferably from about 600° F. to 725° F., at a feed space velocity of from about 0.2 to 2.0 V/V/Hr., preferably from about 0.5 to 1.0 V/V/Hr. Pressure is maintained at from about 500 to 2500 psig, preferably from about 1000 to 1500 psig, and hydrogen is fed into the reactor at a rate of about 500 to 10,000 SCF/B, preferably from about 2000 to 6000 SCF/B. The conditions in hydroisomerization reactor R-2 are preferably selected to convert about 10 to 35 weight percent (wt.%), preferably 15 to 30 wt% to distillate and lighter (650° F.−), of the hydrotreated Fischer-Tropsch wax delivered to R-2. It has been found that such conversion in the 15 to 30 percent range maximizes the production of the desired lubricating oil product.

The catalyst employed in hydroisomerization reactor R-2 is a particulate fluorided Group VIII metal-on-alumina catalyst composition where Group VIII refers to the Periodic Table of Elements (E. H. Sargent & Co., Copyright 1964 Dyna-Slide Co.). Platinum is the preferred Group VIII metal. Alumina is the catalyst base and for purposes of this invention alumina includes alumina-containing materials such as silica alumina and the like.

The fluorided Group VIII metal-on-alumina catalyst comprises about 0.1 to about 2 percent, preferably from about 0.3 to about 0.6 percent Group VIII metal and from about 2 percent to about 10 percent fluoride, preferably from about 5 percent to about 8 percent fluoride, based on the total weight of the catalyst composition (dry basis), such fluoride concentration being herein referred to as the bulk fluoride concentration.

The particulate catalyst of the invention will have a fluoride concentration less than about 3.0 weight percent, preferably less than about 1.0 weight percent and most preferably less than 0.5 weight percent at its outer surface layer, provided the surface fluoride concentration is less than the bulk fluoride concentration. The outer surface layer is measured to a depth less than one one hundredth of an inch. The surface fluoride was measured by scanning electron microscope. The remaining fluoride is distributed with the Group VIII metal at a depth below the outer shell into and within the particle interior.

The fluoride content of the catalyst can be determined in a number of ways.

One technique analyzes the fluorided catalyst using oxygen combustion methodology which is well established in the literature. Approximately 8–10 mgs of sample is mixed with 0.1 g benzoic acid and 1.2 gms of mineral oil in a stainless steel combustion capsule which is mounted in a 300 mL. Parr oxygen combustion bomb. The "sample" is purged of air and subsequently combusted under 30 Atms of pure oxygen. Combustion products are collected in 5 mL. of deionized water. Once the reaction has gone to completion (about 15 minutes), the absorbing solution is quantitatively transferred and made to fixed volume.

Fluoride concentration of the sample is determined by ion chromatography analysis of the combustion product solution. Calibration curves are prepared by combusting several concentrations of ethanolic KF standards (in the same manner as the sample ) to obtain a 0–10 ppm calibration range. Fluoride concentration of the catalyst is calculated on an ignition-loss-free-basis by comparison of the sample solution response to that of the calibration curve. Ignition loss is determined on a separate sample heated to 800 degrees F. for at least 2 hours. Ion chromatographic analysis uses standard anion conditions.

Another procedure employs the use of fluoride distillation with a titrimetric finish. Fluorides are converted into fluorosilicic acid ($H_2SiF_6$) by reaction with quartz in phosphoric acid medium, and distilled as such using super heated steam. This is the Willard-Winter-Tananaev distillation. It should be noted that the use of super heated, dry (rather than wet) steam is crucial in obtaining accurate results. Using a wet steam generator yielded results 10–20% lower. The collected fluorosilicic acid is tritrated with standardized sodium hydroxide solution. A correction has to be made for the phosphoric acid which is also transferred by the steam. Fluoride data are reported on an ignition-loss-free-basis after determination of ignition loss on sample heated to 400 degree C. for 1 hour.

The platinum contained on the alumina component of the catalyst will preferably have an average crystallite size of up to 50Å, more preferably below about 30Å.

The preferred catalyst of the invention will be relatively free of nitrogen and, accordingly, the catalyst will have a nitrogen/aluminum (N/Al) ratio less than about 0.005, preferably less than about 0.002, and most preferably less than about 0.0015.

The catalyst used in the hydroisomerization reactor R-2 will have high intensity peaks characteristic of aluminum fluoride hydroxide hydrate as well as the peaks normally associated with gamma alumina. X-ray diffraction data (X-ray Diffractometer, Scintag U.S.A.) show that the fluoride present in the preferred catalyst will be substantially in the form of aluminum fluoride hydroxide hydrate. This catalyst is described in detail in co-pending application OP-3402 filed in the names of Glen P. Hamner and Willard H. Sawyer.

The relative X-ray diffraction peak height at 20 =5.66Å is taken as a measure of the aluminum fluoride hydroxide hydrate content of the catalyst. The 5.66Å peak for the Reference Standard is taken as a value of 100. For example, fluorided platinum-on-alumina catalyst having a hydrate level of 60 would therefore have a 5.66Å peak height equal to 60% of the 5.66Å peak height of the Reference Standard, with a value of 80 corresponding to a catalyst having a 5.66Å peak height equal to 80% of the 5.66Å peak height of the Reference Standard etc. The catalyst used in reactor R-2 will have a hydrate level of at least 60, preferably at least 80, and most preferably at least about 100.

The Reference Standard contains 0.6 wt% Pt and 7.2 wt% F on $\gamma$ alumina having a surface area of about 150 $m^2/g$. The Reference Standard is prepared by treatment of a standard reforming grade platinum on alpha alumina material containing 0.6 wt% Pt on 150 $m^2/g$ surface area $\gamma$ alumina with platinum, followed by single contact with an aqueous solution containing a high concentration of hydrogen fluoride (e.g., 10–15 wt% HF solution such as 11.6 wt% HF solution) with drying at 300° F. in accordance with the following procedure.

The catalyst employed in R-2 may be prepared in the following manner. The Group VIII metal, preferably platinum, can be incorporated with the alumina in any suitable manner, such as by coprecipitation or co-gellation with the alumina support, or by ion exchange with the alumina support. In the case of a fluorided platinum-on-alumina catalyst, a preferred method for adding the platinum group metal to the alumina support involves the use of an aqueous solution of a water soluble compound, or salt of platinum to impregnate the alumina support. For example, platinum may be added to the support by co-mingling the uncalcined alumina with an aqueous solution of chloroplatinic acid, ammonium chloroplatinate, platinum chloride, or the like, to distribute the platinum substantially uniformly throughout the particle. Following the impregnation, the impregnated support can then be dried and subjected to a high temperature calcination, generally at a temperature in the range from about 700°0 F. to about 1500° F., preferably from about 850° F. to about 1300° F., generally by heating for a period of time ranging from about 1 hour to about 20 hours, preferably from about 1 hour to about 5 hours. The platinum component added to the alumina support, is calcined at high temperature to fix the platinum thereupon prior to adsorption of a fluoride, suitably hydrogen fluoride or hydrogen fluoride and ammonium fluoride mixtures, into the platinum-alumina composite. Alternatively the solution of a water soluble compound, or salt of platinum can be used to impregnate a pre-calcined alumina support, and the platinum-alumina composite again calcined at high temperature after incorporation of the platinum.

The Group VIII metal component is substantially uniformly distributed throughout a precalcined alumina support by impregnation. The Group VIII metal-alumina composite is then calcined at high temperature and the fluoride, preferably hydrogen fluoride, is distributed onto the precalcined Group VIII metal-alumina composite in a manner that most of the fluoride will be substantially composited at a level below the outer surface of the particles.

The catalyst having the fluoride substantially in the form of aluminum fluoride hydroxide hydrate is preferably prepared in the following manner. The platinum is distributed, generally substantially uniformly throughout a particulate alumina support and the platinum-alumina composite is calcined. Distribution of the fluoride on the catalyst, preferably hydrogen fluoride, is achieved by a single contact of the precalcined platinum-alumina composite with a solution which contains the fluoride in sufficiently high concentration. Preferably an aqueous solution containing the fluoride in high concentration is employed, a solution generally containing from about 10 percent to about 20 percent, preferably from about 10 percent to about 15 percent hydrogen fluoride. Solutions containing hydrogen fluoride in these concentrations will be adsorbed to incorporate most of the hydrogen fluoride, at an inner layer below the outer surface of the platinum-alumina particles.

The platinum-alumina composite, after adsorption thereupon of the fluoride component is heated during preparation to a temperature ranging up to but not exceeding about 650° F., preferably about 500° F., and more preferably 300° F. Where a $HF/NH_4F$ solution is used to incorporate the fluoride, the catalyst is dried at a temperature ranging up to but not exceeding about 850° F. A characteristic of the inner platinum-fluoride containing layer is that it contains a high concentration of aluminum fluoride hydroxide hydrate. It can be shown by X-ray diffraction data that a platinum-alumina catalyst formed in such manner displays high intensity peaks characteristic of both aluminum fluoride hydroxide hydrate and gamma alumina.

The isomerate from R-2 may be fractionated and then dewaxed or it may first be introduced with hydrogen into hydrofinishing reactor R-3 containing a hydrogenation catalyst to hydrogenate the unsaturates present in the isomerate product and thereby improve its daylight stability. The reactor conditions are relatively mild and include, for example, a temperature in the range of about 340°-450° F., preferably about 356° F. to 425° F., at pressures of about 300 to 1500 psi $H_2$, preferably 500 to 1000 psi $H_2$, a gas rate of about 500 to 10,000 SCF/B, preferably 1000 to 5000 SCF/B and a space velocity of about 0.25 to 20 V/V/Hr., preferably about 1-4 V/V/Hr.

The catalyst employed in R-3 includes, for example, the hydroisomerization catalyst employed in R-3 or a noble Group VIII metal on a refractory metal oxide such as alumina, silica-alumina and the like.

The effluent from R-3 is fractionated in distillation tower F-1 to produce an overhead light end product boiling below 640°-1000° F., preferably in the range of 700° F.-900° F. and a residual fraction. The lubricating oil fraction is then introduced into the dewaxing zone D-1 where unconverted wax is removed to result in a lubricating oil having a viscosity index of at least 130, preferably a viscosity index greater than 140, and a pour point no greater than 0° F. and preferably a pour point below −6° F. The residual fraction from F-1 will typically have an initial boiling point at atmospheric pressure above 1000° C. and will be recycled with the wax from D-1 to the hydroisomerization reactor R-2.

Dewaxing in D-1 is accomplished by techniques which permit the recovery of unconverted wax, since, as indicated, this unconverted wax is recycled to the hydroisomerization unit. Solvent dewaxing is utilized in D-1 and employs typical dewaxing solvents. Solvent dewaxing utilizes typical dewaxing solvents such as $C_{34}$-$C_6$ ketones (e.g. methyl ethyl ketone, methyl isobutyl ketone and mixtures thereof), $C_6$-$C_{10}$ aromatic hydrocarbons (e.g. toluene) mixtures of ketones and aromatics (e.g. MEK/toluene), autorefrigerative solvents such as liquified, normally gaseous $C_3$-$C_4$ hydrocarbons such as propane, propylene, butane, butylene and mixtures thereof, etc. at filter temperature of −18° F. to −22° F. The isomerate may be dewaxed under miscible conditions with a high yield of dewaxed oil at a high filter rate with a mixture of MEK/MIBK (20/80) used at a temperature in the range −18° F. to −22° F. Pour points lower than −6° F. can be achieved using lower filter temperatures and other ratios of said solvent but a penalty may be paid due to operation under immiscible conditions, the penalty being lower filter rates.

The invention is further illustrated by the following examples.

EXAMPLE

A synthetic hydrocarbon wax (Fischer-Tropsch source) feed was obtained as a 700° F.+fraction by the distillation of a total Fischer-Tropsch synthesis product. THe synthesis wax feed had the following properties:

Melting Point, °F.: >220
Oil Content, wt%: nil
Sulfur, ppm: nil
Nitrogen, ppm: nil
Oxygen, wt%: 0.34
Metals (Fe,Co): trace The wax feed was hydroisomerized over a platinum on fluorided alumina catalyst having the following composition:

| | |
|---|---|
| Platinum concentration, wt % | 0.58 |
| Platinum Cystallite size Å | 26 |
| Fluorine, wt % | 7.9 |
| Aluminum Fluoride Hydroxide Hydrate level intensity @ 5.66Å (X-ray diffraction) | 250 |
| Nitrogen/$Al_2O_3$ Atomic Ratio | 0.005 |
| Surface area, $m^2/g$ | 138 |
| Pore volume, cc/g | 0.42 |

The catalys was reduced with hydrogen @ 650° F. for two hours prior to introducing the 700° F.+ wax feed with hydrogen.

Process conditions for the hydroisomerization and the dewaxing operation with isomerate (700° F.+) so produced are given in Table I with the corresponding dewaxed oil properties.

TABLE I

Dewaxed Oils from Fischer-Tropsch Hydroisomerization

| | | | |
|---|---|---|---|
| Isomerization Conditions | | | |
| Temperature, °F. | 708 | | 716 |
| V/V/Hr. | | 1 | |
| Pressure, psi | | 1000 | |
| Treat Gas, SCF $H_2$/bbl. | | 2500 | |
| Conversion to 700° F.−, wt % | 13 | | 19 |
| Isomerate (700° F.+) Feed to Dewaxing | | | |
| Cloud Point, °F. | 208 | | 187 |
| Viscosity, cs @ 210° F. | 7.3 | | 6.5 |

TABLE I-continued

| Dewaxed Oils from Fischer-Tropsch Hydroisomerization | | |
|---|---|---|
| Dewaxing Conditions | | |
| Solvent: | 40/60 MEK/Toluene | |
| Diluent-Oil Ratio | 4 to 1 | |
| Filter Temperature °F. | −22 | |
| Dewaxed Oil Properties | | |
| Pour Point °F. | 9 | −4 |
| Viscosity, cs | | |
| @ 100° F. | 39 | 33.8 |
| @ 210° F. | 7.5 | 6.7 |
| Viscosity Index | 163 | 159 |
| Wax Recovered, wt % | 48 | 30 |
| Theoretical Dewax Oil Yield wt % | 52 | 70 |

It is apparent that at low levels of wax conversion and when using typical dewaxing solvents under standard conditions (filter temperature −22° F.), a low yield of dewaxed oil having an unsatisfactory pour point is produced. Lower filtration temperatures would produce the desired pour point but would produce an even lower dewaxed oil yield. Hydroisomerization at a higher level of conversion (e.g. 30% wax remaining in the isomerate 700° F.+) facilitates the production of a lower pour point product within the conventional dewaxing parameters employed in dewaxing plants. A major portion of the unconverted wax is associated with the 1050° F.+isomerate and thus the recycle of this fraction to the isomerization zone would be the preferred method of reducing the wax load to the dewaxing operation, as well as increasing the overall yield of oil from wax.

What is claimed is:

1. A process for producing a lubricating oil having a high viscosity index and a low pour point from a Fischer-Tropsch wax, which process comprises:

(a) contacting the Fischer-Tropsch wax with hydrogen and a hydrotreating catalyst comprising Co, Ni, Mo or W or any mixture of two or more of said metals to reduce the oxygenate and trace metal levels of the wax and to partially hydrocrack and isomerize the wax;

(b) contacting the hydrotreated Fischer-Tropsch wax from step (a) with hydrogen in a hydrosiomerization zone in the presence of a fluorided Group VIII metal-on-alumina catalyst having (i) a bulk fluoride concentration ranging from about 2 to about 10 weight percent, wherein the fluoride concentration is less than about 3.0 weight percent at the outer surface layer to a depth less than one one hundredth of an inch, provided the surface fluoride concentration is less than a bulk fluoride concentration, (ii) an aluminum fluoride hydroxide hydrate level greater than 60 where an aluminum fluoride hydrate level of 100 corresponds to the X-ray diffraction peak height of 5.66Å for a Reference Standard, and (iii) a N/Al ratio less than about 0.005;

(c) fractionating the effluent from step (b) to produce a lubricating oil fraction boiling above about 640° F. at atmospheric pressure; and (d) dewaxing the lubricating oil fraction from step (c) to produce a dewaxed lubricating oil having a viscosity index of at least 130 and a pour point less than about 0° F.

2. The process of claim 1 wherein the Group VIII metal on the catalyst employed in step (b) is platinum and wherein the hydrotreating catalyst employed in step (a) is unsulfided.

3. The process of claim 1 wherein said catalyst contains about 0.3 to about 0.6 weight percent platinum and about 5 to about 8 weight percent fluoride.

4. The process of claim 2 wherein the Fischer-Tropsch wax is subjected to severe hydrotreating conditions in step (a) including a temperature of about 700° F.–750° F. and a hydrogen pressure of about 1000° F.–1500° F. psig.

5. The process of claim 5, wherein about 10–30 wt% of the Fischer-Tropsch wax introduced into the hydroisomerization zone is converted to distillate and lighter products.

6. The process of claim 6 wherein the lubricating oil fraction recovered from step (c) has a boiling point in the range of about 700° F.–1000° F.

7. The process of claim 7 wherein the fluorided platinum-on-alumina catalyst has an aluminum fluoride hydroxide hydrate level of at least about 100.

8. The process of claim 8 wherein a residual fraction is recovered from step (c) and said residual fraction is recycled to the hydroisomerization zone.

9. The process of claim 9 wherein the effluent from the hydroisomerization zone is contacted with hydrogen and a hydrogenation catalyst under mild hydrofinishing conditions including a temperature of about 340° F.–450° F. and a pressure about 300 psi–1500 psi.

10. The process of claim 10 wherein the hydrogenation catalyst is a fluorided Group VIII metal on an alumina-containing base catalyst.

11. The process of claim 10 wherein the dewaxed lubricating oil recovered has a viscosity index of at least 140 and a pour point less than about −6° F.

12. The process of claim 11 wherein the Group VIII metal present on the hydrogenation catalyst is platinum.

13. A process for producing a lubricating oil having a high viscosity index and a low pour point from a Fischer-Tropsch wax, which process comprises:

(a) contacting the Fischer-Tropsch wax with hydrogen and an unsulfided hydrotreating catalyst comprising Co, Ni, Mo or W or any mixture of two or more of said metals to reduce the oxygenate and trace metal levels of the wax and to partially hydrocrack and isomerize the wax;

(b) contacting the hydrotreated Fischer-Tropsch wax from step (a) with hydrogen in a hydroisomerization zone in the presence of a fluorided platinum-on-alumina catalyst having (i) a bulk fluoride concentration ranging from about 2 to about 10 weight percent, wherein the fluoride concentration is less than about 3.0 weight percent at the outer surface layer to a depth less than one one hundredth of an inch, provided the surface fluoride concentration is less than the bulk fluoride concentration, (ii) an aluminum fluoride hydrate level greater than 60 where an aluminum fluoride hydrate level of 100 corresponds to the X-ray diffraction peak height of 5.66Å for a Reference Standard, and (iii) a N/Al ratio less than about 0.005, (c) contacting the isomerate from step (b) with hydrogen and the platinum-on-alumina catalyst defined in step (b) in a hydrofinishing zone run at mild conditions to reduce unsaturation of the isomerate and thereby improve its daylight stability and oxidation stability, (d) fractionating the effluent from step (c) to produce a lubricating oil fraction boiling above about 700° F. at atmospheric pressure; and (e) dewaxing the lubricating oil fraction from step (d) to produce a dewaxed lubricating oil having a viscosity index of at least 140 and a pour point less than about −6° F.

14. The process of claim 14 wherein about 15–30 wt% of the Fischer-Tropsch wax introduced into the hydroisomerization zone is converted therein to distillate and lower boiling material.

* * * * *